United States Patent [19]

Snook et al.

[11] Patent Number: 4,657,666

[45] Date of Patent: Apr. 14, 1987

[54] MAGNETIC FLOTATION

[75] Inventors: Harvey Snook, Aspendale; Terence C. Hughes, North Carlton, both of Australia

[73] Assignee: W.S.R. Pty. Ltd., Australia

[21] Appl. No.: 759,917

[22] PCT Filed: Oct. 26, 1982

[86] PCT No.: PCT/AU82/00174

§ 371 Date: Jun. 7, 1983

§ 102(e) Date: Jun. 7, 1983

[87] PCT Pub. No.: WO83/01397

PCT Pub. Date: Apr. 28, 1983

Related U.S. Application Data

[63] Continuation of Ser. No. 511,136, Jun. 7, 1983, abandoned.

[30] Foreign Application Priority Data

Oct. 26, 1981 [AU] Australia ..... PF1302/81

[51] Int. Cl.[4] ..... B03G 1/00

[52] U.S. Cl. ..... 209/8; 209/9; 209/47; 209/214

[58] Field of Search ..... 209/3, 4, 5, 8, 9, 47, 209/39, 166, 214, 232; 210/222; 232/49.6

[56] References Cited

U.S. PATENT DOCUMENTS

| | | | |
|---|---|---|---|
| Re. 30,360 | 8/1980 | Shubert | 209/214 |
| 933,717 | 9/1909 | Lockwood et al. | 209/9 |
| 1,043,831 | 11/1912 | Lockwood | 209/47 |
| 3,929,627 | 12/1975 | Frangiskos et al. | 209/47 |
| 4,125,460 | 11/1978 | Nott et al. | 209/214 |
| 4,219,408 | 8/1980 | Price et al. | 209/214 |
| 4,343,694 | 8/1982 | Cook et al. | 209/9 |
| 4,356,098 | 10/1982 | Chagnon | 252/49.6 |

*Primary Examiner*—Charles Hart

*Attorney, Agent, or Firm*—Sughrue, Mion, Zinn, Macpeak, and Seas

[57] ABSTRACT

A method for mineral upgrading or concentration, characterized in that a gangue-associated mineral having a hydrophobic surface and being in particulate form, is contacted with particles of a magnetic material also having a hydrophobic surface, whereby the mineral particles become attached to the surface of the magnetic particles, the magnetic particles with the attached mineral particles are separated from the gangue by magnetic means, and the mineral particles are then detached from the magnetic particles.

7 Claims, No Drawings

MAGNETIC FLOTATION

This is a continuation of application Ser. No. 511,136, filed June 7, 1983 and now abandoned.

BACKGROUND OF THE INVENTION

This invention relates to mineral upgrading or concentration method involving the use of magnetic particles having hydrophobic surfaces, as extractants for minerals with hydrophobic surfaces or especially surfaces made hydrophobic by the use of the reagents normally used for air flotation concentration.

A considerable art has been developed to separate minerals from associated gangue using air bubbles. Typically a collecting reagent, such as sodium ethylxanthate, is added to an aqueous suspension of a mineral, for example chalcopyrite containing a silica gangue. The ethylxanthate ions are preferentially adsorbed by the chalcopyrite. If small air bubbles are then made to contact both silica and chalcopyrite particles, only the chalcopyrite particles adhere and they can then be floated to the surface of the suspension and separated by skimming the surface. The air bubbles are attached to the mineral by the surface tension developed in the ring where the mineral protrudes into the air bubbles. The air bubbles have buoyancy which counteracts the gravitational force on the particles of mineral thus allowing flotation to occur. In many instances the bubbles must be stabilised with frothing agents to maintain the bubble with particles on the surface for sufficient time to permit skimming of the floated mineral particles.

SUMMARY OF THE INVENTION

This invention seeks to provide a concentration method which resembles the art of flotation but uses hydrophobic magnetic particles instead of air bubbles as the separating medium. The invention also aims to provide a method of mineral concentration which represents an improvement over the use of air bubbles.

According to the present invention there is provided a method for mineral upgrading or concentration wherein a gangue-associated mineral having a hydrophobic surface and being in particulate form, is contacted with particles of a magnetic material also having a hydrophobic surface, whereby the mineral particles become attached to the surface of the magnetic particles, the magnetic particles with the attached mineral particles are separated from the gangue by magnetic means, and the mineral particles are then detached from the magnetic particles.

DETAILED DESCRIPTION OF THE INVENTION

Contact of the mineral to the magnetic particles may be carried out by mixing the particles in a fluid, preferably aqueous liquid, suspension, or the particles may be mixed together in the dry state.

Generally, the mineral particles will require pretreatment to provide the necessary hydrophobic surface. Any of the known reagents or treatment procedures used in conventional flotation processes may be used for this purpose.

Although some suitable magnetic materials, such as for example, magnetite, are known to have naturally hydrophobic surfaces and it will usually be necessary to treat the magnetic materials to provide a surface having the desired level of hydrophobicity.

All the currently known magnetic materials can be made hydrophobic. In general, the magnetic oxide materials such as magnetite, haematite, ilmenite, and the ferrites, can be activated by either concentrated acid or alkali to give a surface rich in hydroxyl radicals that can be used to attach alkyl silane or alkyl siloxane and other organic reagents by methods known per se to produce hydrophobic surfaces. Magnetic metals, such as iron, nickel, cobalt and their alloys, e.g., alloys of rare earth elements and cobalt, can be made hydrophobic by producing either hydroxyl-rich surfaces in weak alkaline solutions or by generating a thin glass layer on their surface and then further treating the surface with alkyl silanes, alkyl siloxanes and like organic reagents.

The concentrated mineral particles may be detached from the magnetic particles by any suitable method. For example, the flotation reagent may be destroyed with oxidising reagents such as hypochlorite, hydrogen peroxide or air, or by pyrolitic degradation. Alternatively, the flotation reagent may be displaced by ions such as cyanide or hydroxide. Detachment may also be achieved mechanically, i.e., by violent agitation, for example that caused by intense oscillating magnetic field.

Separation of the mixed mineral/magnetic particles from the gangue and separation of the magnetic particles from the mineral particles after detachment may be achieved by any suitable magnetic separation apparatus of conventional or specifically-designed type.

The optimum size for the magnetic particles for any particular application will be best determined by experiment. Generally the magnetic particles should be at least comparable in size with the mineral particles and preferably somewhat larger. We have found that for most applications involving mineral particles of 100 mesh BSS or smaller magnetite particles of −60 to +100 mesh are most suitable.

The method of the invention is very suitable for the upgrading of slimes and sludges containing very fine mineral particles, e.g., those unamenable to concentration by flotation techniques.

The method of the invention also has other advantages. Firstly, the mineral particles are attached to the magnetic particles by both the forces of surface tension and also the considerable van der Waals forces between the hydrophobic molecules on the magnetic particles and the flotation reagent molecules on the mineral particles. These forces when combined enable larger mineral particles to be separated more reliably. When very fine mineral particles are floated, the hydrophobic surfaces exert a powerful force on miscelles of mineral by spreading them over the active surface. The effect can be increased by using magnetic particles with indented surfaces which allow increased area of contact and an increased resolved surface tension force towards the magnetic particles.

Secondly, the energy required to separate a magnetic particle using a conventional magnetic separator is much less than the energy required to compress air to make bubbles and then skim the surface.

Thirdly, the magnetic flotation does not require frothing reagents, which constitute roughly ten per centum of the cost of running a conventional flotation process.

The invention is illustrated by the following examples.

EXAMPLE 1

A sample of magnetite was screened and the size range −60 +100 mesh BSS retained for silanizing. The surface was cleaned with 1% sodium EDTA, which was adjusted to pH 10 with ammonia, then washed with distilled water. The magnetite was dried at 100° C. and when cool, a 30 gram sample was taken and stirred into a 1% solution of Dow Corning Z-6020 silane (N-β-aminoethyl-γ-aminopropyltrimethoxysilane) then decanted to remove excess reagent. The reaction was completed by drying the treated magnetite at 100° C. for 2 hours.

10 g of molybdenite ore from Everton, Victoria, passing 50 mesh BSS was ground under nitrogen into a surface-activating solution of 1% sodium ethylxanthate and 0.25% sodium cyanide adjusted to pH 8–9. Excess reagent was removed by decantation. 5 g of the silanised magnetite in 100 ml of water was then mixed into the activated ore with gentle stirring for 10 minutes under nitrogen, then recovered by magnetically removing the magnetite (with attached molybdenite) upwards out of the solution with a magnet, and dried to give 4.1 g. The molybdenite was then recovered by treatment with 20 ml of 50 vol. hydrogen peroxide for 10 minutes followed by agitation and magnetic removal of the magnetite to leave concentrated molybdenite which when dried was found to weigh 1.4 g. Analysis showed a 6.2:1 concentration of molybdenite from the ore to the concentrate.

EXAMPLES 2–4

Using the method of Example 1, the following ores were concentrated as tabulated below.

| Example | Ore | Metal/Concentration achieved |
|---|---|---|
| 2 | Pyrite[1] | Fe 5.1:1 |
| 3 | Chalcopyrite[2] | Cu 6.7:1 |
| | | Fe 8.1:1 |
| 4 | Lead/zinc[3] | Pb 4.0:1 |
| | | Zn 5.1:1 |

[1]From Broken Hill, NSW, Australia
[2]From Mt. Lyle, Tasmania
[3]Freshly-mined high grade ore from Broken Hill, NSW, Australia

EXAMPLE 5

The use of haematite instead of magnetite in the above experiments gave similar results to those stated, the only major difference being that a more powerful magnet was required to lift the material out of the suspension.

50 g of a screened sample of haematite (−100+120 mesh BSS) was heated at about 700° C. for 2–3 hours in a nickel crucible which was flushed with nitrogen. The crucible was covered and removed from the furnace and the contents poured into 100 ml of absolute alcohol containing 0.5 ml of glacial acetic acid. Z-6020 silane (1 ml) was added with stirring and the mixture was then stirred for 5–10 minutes, decanted, and the solid washed with distilled water and dried at about 120° C. for 2 hours.

Using the lead/zinc ore of Example 4, the concentrations achieved were Pb 5.0:1; Zn 4.5:1.

What is claimed is:

1. A method for mineral upgrading or concentration comprising the following steps:

providing a gangue associated mineral having a hydrophobic surface and in particulate form, providing a magnetic material in particulate form, silanizing the magnetic material in order to provide a hydrophobic surface, contacting the gangue associated mineral with the magnetic material in an aqueous liquid, whereby the mineral particles become attached to the surface of the magnetic particles by virtue of interaction between the hydrophobic surfaces of the particles, separating the magnetic particles with attached mineral particles from gangue by magnetic means, detaching the mineral particles from the magnetic particles.

2. A method as claimed in claim 1, characterised in that the particles are contacted by mixing in an aqueous liquid.

3. A method as claimed in claim 1 or claim 2, characterised in that the magnetic material has been silanized to provide the hydrophobic surface.

4. A method as claimed in claim 1, characterised in that the mineral particles are rendered hydrophobic by treatment with a flotation reagent and the magnetic material has been silanized to provide the hydrophobic surface.

5. A method as claimed in claim 4, characterised in that the mineral particles are detached from the magnetic particles after separation by destruction of the flotation reagent.

6. A method as claimed in claim 1, characterised in that the particle size of the magnetic material is at least comparable with that of the mineral.

7. A method as claimed in claim 1, wherein the magnetic material is magnetite, haematite, ilmenite, a ferrite or a magnetic metal or alloy.

* * * * *